US005931205A

United States Patent [19]

Jasica et al.

[11] Patent Number: 5,931,205

[45] Date of Patent: Aug. 3, 1999

[54] PACKAGING

[75] Inventors: Kazimierz Stanislaw Jasica; John Cameron Sadler; Darryn Kerry Shepherd, all of Auckland, New Zealand

[73] Assignee: Containers Packaging (N.Z.) Limited, New Zealand

[21] Appl. No.: 08/836,270

[22] PCT Filed: Oct. 30, 1995

[86] PCT No.: PCT/NZ95/00111

§ 371 Date: Jul. 9, 1997

§ 102(e) Date: Jul. 9, 1997

[87] PCT Pub. No.: WO96/14256

PCT Pub. Date: May 17, 1996

[30] Foreign Application Priority Data

Nov. 3, 1994 [NZ] New Zealand ..... 264853

[51] Int. Cl.[6] ..... B65B 1/04

[52] U.S. Cl. ..... 141/286; 239/687

[58] Field of Search ..... 141/67, 68, 286, 141/313, 317; 239/687, 688

[56] References Cited

U.S. PATENT DOCUMENTS

| | | | |
|---|---|---|---|
| 2,696,235 | 12/1954 | Toffolon . | |
| 3,329,322 | 7/1967 | Herd | 239/687 |
| 3,804,273 | 4/1974 | Uhl . | |
| 4,457,456 | 7/1984 | Derby et al. . | |
| 4,532,885 | 8/1985 | Nunlist | 239/687 |
| 4,902,185 | 2/1990 | Dixon et al. | 239/688 |
| 5,399,198 | 3/1995 | Ghaisas | 239/687 |

FOREIGN PATENT DOCUMENTS

| | | |
|---|---|---|
| 26648/71 | 3/1971 | Australia . |
| 39509/72 | 3/1972 | Australia . |
| 206520 | 11/1985 | New Zealand . |
| 220252 | 9/1988 | New Zealand . |

OTHER PUBLICATIONS

Japanese Abstract: Flexible Container For Powder. Application No. 64–185280 May 29, 1990.

*Primary Examiner*—Steven O. Douglas

*Attorney, Agent, or Firm*—Mathews, Collins, Shepherd & Gould, P.A.

[57] ABSTRACT

Packaging particularly for bulk materials can include container flexible container which can be contained and suspended within a lifting cradle (11) and about which lifting cradle (11) and the inner container an outer container can be positioned. The lifting cradle (11) has an outlet (14) so as to coincide with the outlet in the base of the inner container and to enable the discharge of materials from the inner container without the need to remove the lifting cradle (11). Lifting straps (15) can provide a loose connection with connectors from the upper portion of the inner container so that when suspended the weight of the inner container and its contents is taken by the lifting cradle (11) and not by the inner container.

3 Claims, 3 Drawing Sheets

PACKAGING

BACKGROUND OF THE INVENTION

The present invention relates to improvements to packaging and more particularly but not exclusively, the present invention relates to packaging and packaging handling apparatus for bulk materials such as powdered or granulated material including milk powder. However it is to be appreciated that the present invention has application wherever any material is required to be packaged.

In the case of bulk material such as milk powder, various forms of packages have been proposed which will facilitate the packages being filled, transported, and subsequently emptied. In the case of a food product such as a milk powder there needs of course to be the observance of strict hygiene requirements and various complex packages have been proposed which will eliminate or at least substantially minimise the chance of contamination of the food product. In such instances an inevitable result has been a package of complexity and attendant costs which is also typically difficult to use. In practice, it can require the sealing and unsealing of various layers which avoid dust, dirt or other contaminants and including human contact, from contaminating the contained product.

In the packaging of bulk materials, there have also been various proposals which will facilitate the packaging, storage and transport of large quantities of material in various forms of containers. One such proposal is the subject of various patents such as New Zealand patent 233690 relating to what is known as the GAMBO (trade mark) bag which by its construction enables a substantially square shape to be retained even after the bag has been filled.

The present invention has particular application to its use with a GAMBO bag but those skilled in the engineering and the packaging arts will appreciate that the present invention will find application in improving the packaging and handling of numerous other types of packaging including but not limited to large plastic bags of the GAMBO type.

It is thus an object of the present invention to provide a packaging means and/or method which will overcome or at least obviate disadvantages in presently available packaging or at least will provide the public with a useful choice.

Further objects of this invention will become apparent from the following description.

BRIEF SUMMARY OF THE INVENTION

According to one aspect of the present invention there is provided a lifting harness for a container comprising a base portion adapted in use to be positionable about a base of the container, said base portion being provided with, or being capable of being provided with, an outlet means through which material contained in said container can exit as it is discharged through said container base, a plurality of lifting means each having free ends adapted to be securable in use, with a suspension means, said lifting means being adapted to be, in use, connectable with an upper portion of said container to position said lifting means relative to said upper portion of said container.

Preferably a lifting harness as above defined further includes a lateral support means adapted to extend about said lifting means part way along their respective vertical lengths.

According to a further aspect of the present invention there is provided a package assembly comprising:

(a) an inner flexible container;

(b) a harness having a base portion adapted to be positionable about a base of said inner container and further having a plurality of lifting means having free ends adapted in use to be connectable with a suspension means;

(c) an outer container adapted to be releasably positionable about said harness and said inner container in covering over same;

wherein said base portion of said harness provides, or can provide, an outlet means adapted in use to coincide with an outlet provided in the base of said inner container whereby after the removal of said outer container (if it is not provided with or providable with its own outlet) material within said inner container can be discharged therefrom and through said outlet means in said base portion.

According to a still further aspect of the present invention a method of filling a container with a material is provided wherein said container has a cross section including corners, said method comprising the discharge of material so as to be directed into said corners.

According to a still further aspect of the present invention a method as immediately above defined includes spraying said material from a rotatable discharge means.

According to a still further aspect of the present invention there is provided a material discharge means comprising a material inlet means and a material outlet means, said outlet means including one or more discharge outlets which provide at least a partially lateral discharge of material which for a container having corners in able to discharge at least substantially into said corners.

According to a still further aspect of the present invention there is provided apparatus for and/or a method of packaging and/or a lifting harness and/or a package assembly substantially as herein described with reference to any one of the embodiments of the present invention as herein described and/or with reference to the accompanying drawings.

Further aspects of this present invention which should be considered in all its novel aspects will become apparent from the following description given by way of example and with reference to the accompanying drawings.

DESCRIPTION OF PREFERRED EMBODIMENTS

In the handling of bulk materials a typical prior art structure will include an inner flexible bag which will be filled up with the material such as a powder and an outer flexible bag typically of fabric, the outer bag being provided with the various lifting attachments to enable the filled bag assembly to be transported between required locations and to be suspended when the material is to be discharged. At the time of discharge the base of the outer bag of such prior art proposals will need to be ripped open or otherwise opened out to enable access into the outlet provided in the base of the inner bag. In the case of food products, very complex arrangements may be provided to avoid contamination externally of the outer bag entering into the inner bag. Typically, the outer bag, although an expensive item of manufacture, in that it is typically fairly complex and strong to enable it to achieve its lifting and suspension functions, will be discarded after a single use.

In contrast, the present invention avoids the need for any lifting or suspension function for the outer bag and instead provides a lifting harness which can be used repeatedly and in conjunction with a variety of types of inner and outer bags.

Figure 5:
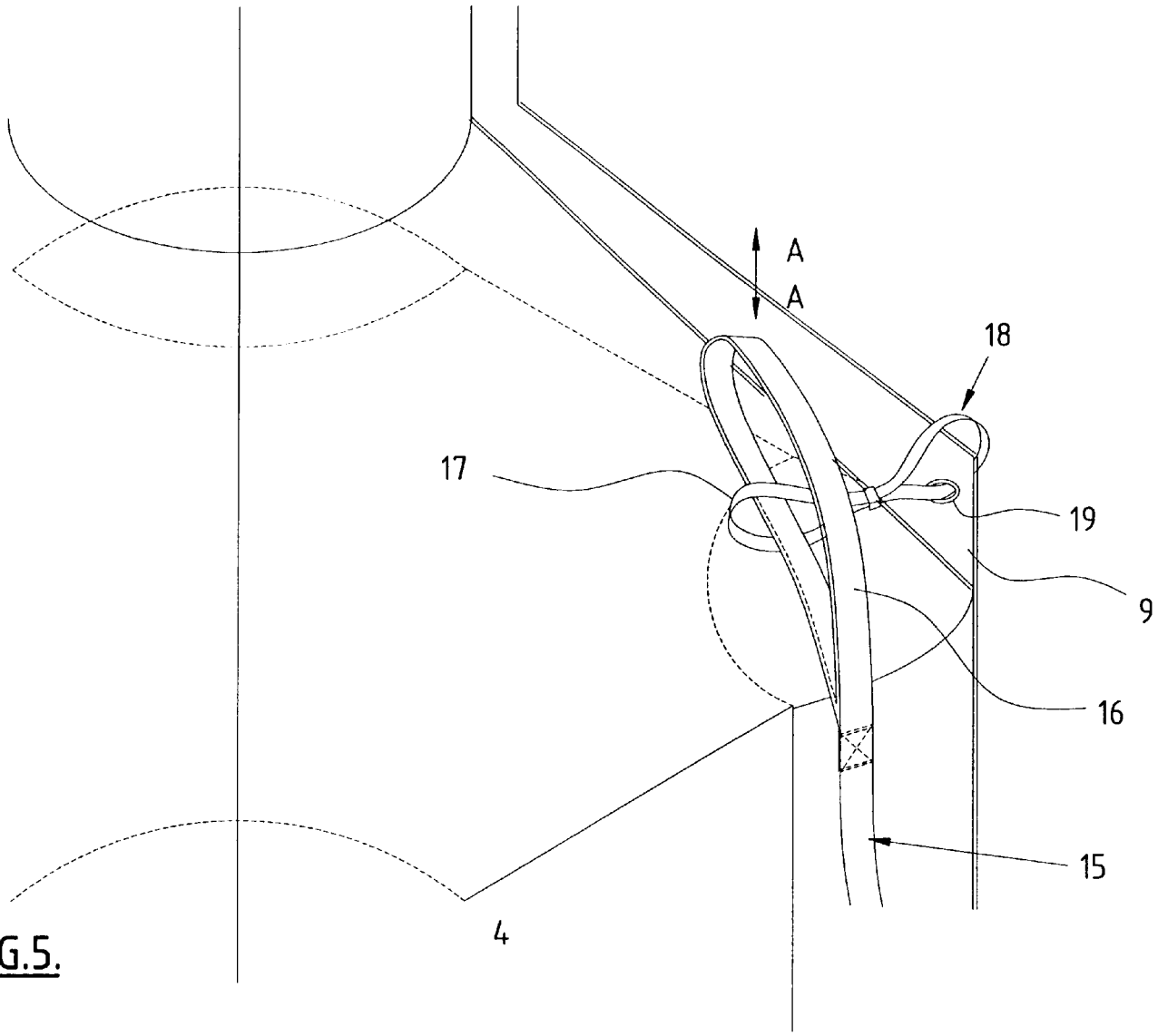
FIG. 5: shows, enlarged, a detail of the upper corner portion "B" of FIG. 1 (*c*).

Referring to FIGS. 1, 1(*a*) shows very diagrammatically an outer bag which may be gussetted or non gussetted, of any suitable construction or material. The outer bag referenced generally by arrow 1 is shown provided with a closed off base 2 and an open upper end 3. The base 2 may however be provided with an outlet, shown in outline at 2*a*, which may be permanent or be exposed such as by tearing or cutting open when required. In use, the open upper end 3 may be closed off by any suitable means and may be provided with closeable flaps, for example, to facilitate such closing. The size of the outer bag 1 will be commensurate with and preferably a tight fit over an inner bag referenced generally by arrow 4, shown in FIG. 1(*c*) The inner bag 4 may be of any suitable type and construction but is illustrated as having an inlet spout 5 and a closed off outlet spout 6. The bag 4 may be of a GAMBO type with a central core 7 and discrete peripheral compartments 8. The bag 4 is also shown provided with upper flanges or webs 9 with attachments such an straps, cord or the like 18, shown in greater detail in FIG. 5.

The base portion 10 of the bag 4 is adapted to be accommodated within a lifting harness referenced generally by arrow 11 and shown very diagrammatically in FIG. 1(*b*).

The harness 11 is shown having a base portion 12 which may be of a suitably strong material and/or may be reinforced particularly at its corners such as by cardboard, plastic or other inserts indicated generally by reference arrow 13. Suitably the base 12 may be of a reinforced fabric for example. The base 12 is also shown provided with at least one outlet 14. The one or more outlets 14 may either be provided as a permanent aperture or may be an outlet which can be closed off until required for use such an by means of a zip, a weakening line or perforations or the like. In a very simple design the outlet 14 may for example be indicated by some indicia or other material to be removed by a knife or the like. Extending upwardly from the base 12 are shown lifting straps 15 having connector portions 16 at respective ends. The straps 15 can extend along the base 12 as shown in outline at 15*a* on either side of the outlet 14. The relative positioning of the strap portions 15*a* in respect of the outlet 14 needs to be determined carefully so that a well defined outlet 14 results when the harness 11 is carrying the weight of a filled inner bag 4. What is aimed for is a concave shape to the base 12 when it is under load, as illustrated by the dotted lines 12*a* in FIG. 1(*b*), which will maintain a full opening of the outlet 14. It has been found that the strap portions 15*a* should be positioned slightly inwardly from the respective corners of the base 12 to facilitate the bowed or concave shape for the base 12 under load.

One or more lateral support means such as strap 11*a* may extend between the straps 15 part way along their respective vertical lengths.

The harness 11 will be positioned about the base 10 of the inner bag 4 and, for filling, typically the inner bag 4 will be inflated. Such inflation expands the inner bag 4 so that it acquires its expanded shape and also becomes substantially self supporting. The outer bag 1 can be slipped over the harness 11 and the inner bag 4 before or after inflation. The size of the outer bag 1 is such that it typically will be held on the harness 11 and the inner bag 4 by the inflated size of the inner bag 4. During the filling operation the assembly of the inner bag 4, harness 11 and outer bag 1 will be suspended by means of the straps 15 connected to a suitable lifting/suspension means. For this purpose, the straps 15 (see FIG. 5) may be provided with loops or the like 16 at their upper ends which can extend through an outer loop 17 of attachment 18 positioned through an eyelet or the like 19 of flange or web 9 provided for the inner bag 4. It in seen that the connection between the loop 16 and the loop 17 is quite a loose or free one so that an the strap 15 comes under tension by tensional forces indicated by arrows $A^1$, these tensional forces will not be transmitted to the inner bag 4 itself. Instead, the weight of the contents of the inner bag 4 will be taken by the cradle 11 and transferred through the straps 15 without imposing any or substantially any corresponding tensional forces on the bag 4 itself. This means that the material of the inner bag 4 can be substantially weaker than may otherwise be the case and may enable the inner bag 4 to be repeatedly used whereas in alternative arrangements a single use may have been all that would have been possible.

Figure 1A:
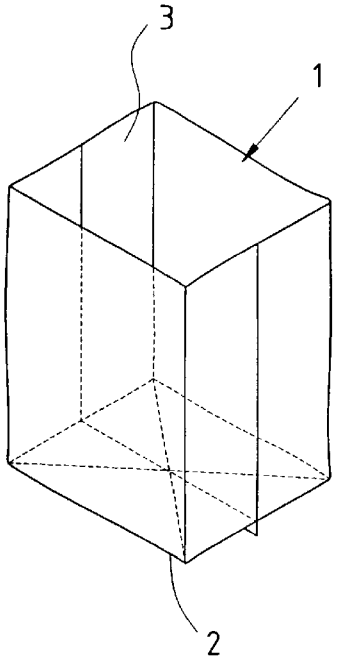
FIGS. 1(*a*), (*b*), (*c*) & (*d*): shows very diagrammatically a packaging assembly according to one possible embodiment to the invention and including a harness according to one possible embodiment to the invention.
Figure 1B:
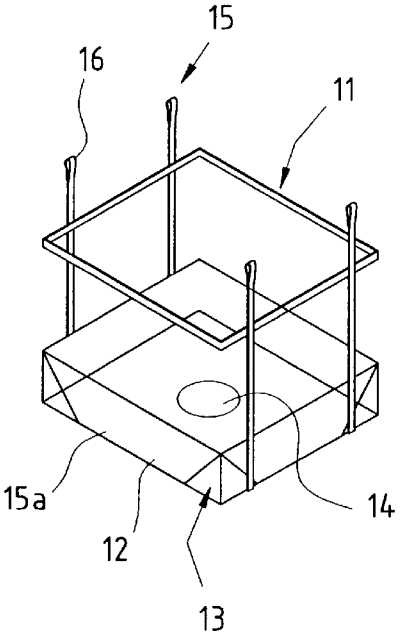
Figure 1C:
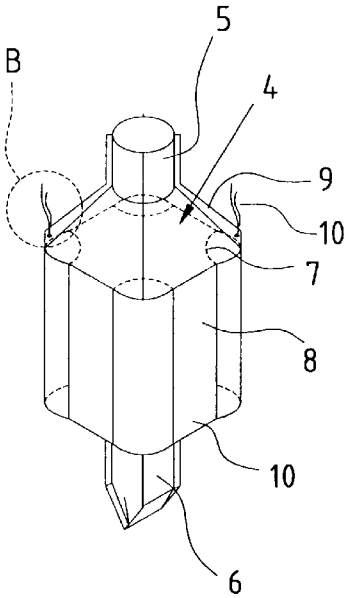
Figure 1D:
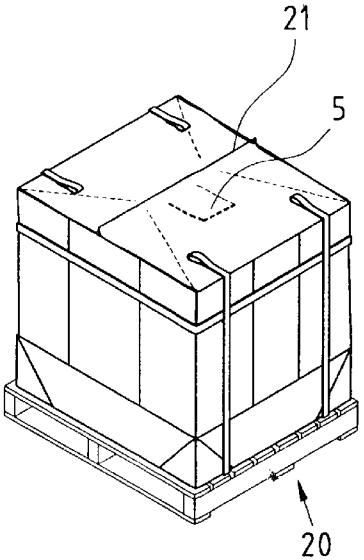

After filling, the filled assembly illustrated in FIG. 1*d* can be positioned on a pallet or the like 20 ready for transporting and/or storage. In that state, the inlet spout 5 will have been sealed off and closed over the top of the inner bag 4 and the top of the outer bag 1 will have been sealed off such as by the seal indicated generally by arrow 21. The outlet spout 6 (not shown in FIG. 1*d*) will have been folded over so as to lie against the outlet 14 of the harness 11 and/or the base 2 of the outer bag 1.

Figure 3:
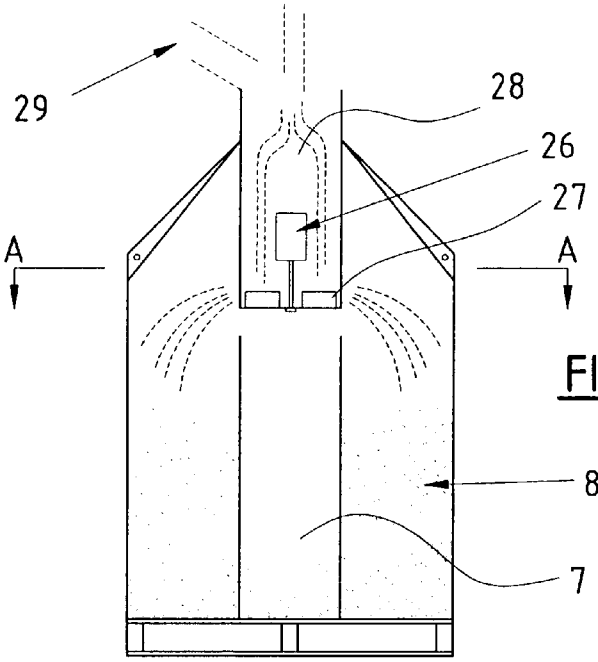
FIG. 3: shows very diagrammatically a packaging filling system according to one possible embodiment of the invention.
Figure 4:
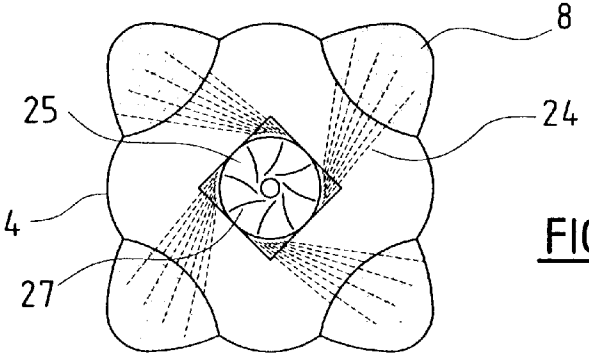
FIG. 4: shows very diagrammatically a cross sectional view along are rows A—A of FIG. 3.
Figure 2:
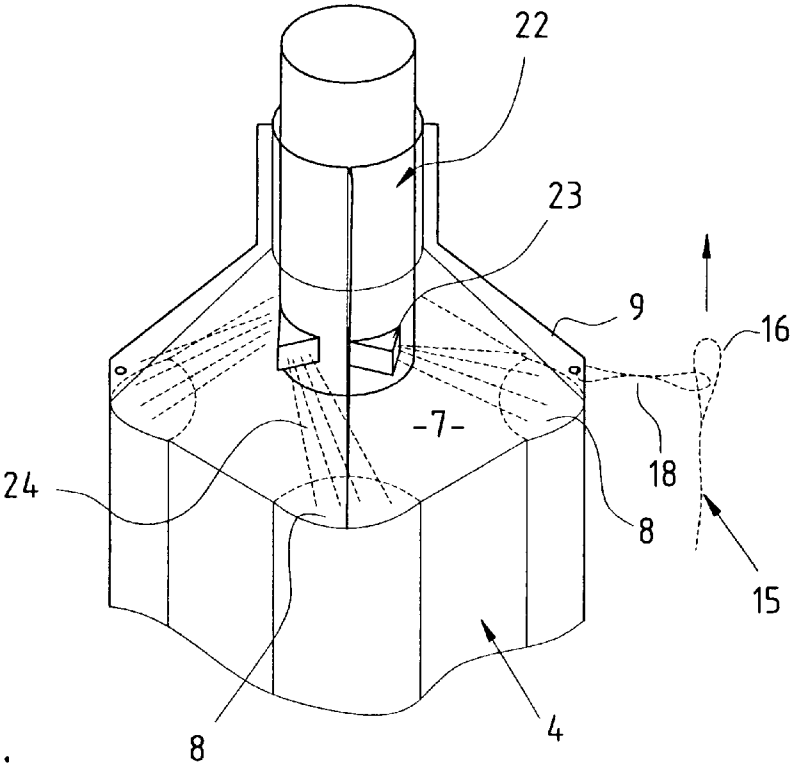
FIG. 2: shows very diagrammatically a top portion of an inner container of one embodiment of the invention and being filled by a filling means according to a possible embodiment of the invention.

In filling the inner bag 4, as illustrated diagrammatically in FIGS. 2 to 4, the inner bag 4 will be suspended from a suitable suspension means by means of the straps 15 and in the case of an inner bag 4 having a central core 7 and outer compartments 8 such as in a GAMBO bag, a problem in the past has been in ensuring that the corners of the bag 4 have been filled. In FIGS. 2, 3 and 4 a filling means according to one possible embodiment of the invention is illustrated very diagrammatically as including a material discharge means 22 having plurality of tangentially disposed outlets 23 enabling a discharge of material 24 directly into the corners 8 of the inner bag 4 so that the corners 8 are filled first, following which the overflow of material will start filling the majority of the central core portion 7 (see FIG. 3). To achieve the tangential discharge 24 a centrifugal discharge means 25 may be rotatably driven such as by a motor 26 so that the vanes or impellors 27 provide a driving force for the material 24 following its receipt through the inlet chute 28.

The initial expansion of the inner bag 4 could suitably be provided by a pressurized air supply or fan connected to an inlet 29 (see FIG. 3). It is envisaged that following expansion the pressurized air may be turned off or reduced and possibly reversed towards the end of the filling operation.

When discharge of the contents of the inner bag 4 is required, the bag can be suspended using its straps 15 and this suspension tends to elongate the inner bag 4 due to the weight of its contents and thereby reduce the overall diameter of the bag 4. It has been found in trials that this facilitates the outer bag 1 being stripped off in that it is no longer such a snug fit on the inner bag 4. With the outer bag 1 stripped off the outlet 6 can be accessed and pulled through the outlet 14 if necessary prior to discharge being obtained. As discharge proceeds there will be a tendency for the bag 4 to collapse in on itself and the attachments 18 connecting the inner bag 4 with the straps 15 will now assist in holding the assembly together and in particular holding the top corners of the inner bag 4. The inner and outer bags 1 and 4 may be made by any suitable technique and from any suitable materials although in a preferred embodiment, suitable plastics materials may suitably be utilised.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope or spirit of the invention as defined in the appended claims.

We claim:

1. A rectangular container comprising:

a central core portion;

four peripheral corners compartments disposed about the central core portion; and filling means positioned above the central core portion, the filling means including material discharge means having a plurality of tangentially disposed outlets for directing discharged material into the peripheral corners compartments of the container, the discharged material overflowing into the central core portion when the compartments are filled, the material discharge means further having an inlet means for feeding material to the discharge means, the discharge means further having a rotatable discharge assembly including rotatably driven vanes or impellers for driving material into the tangentially disposed outlets of the material discharge means.

2. The container according to claim 1, wherein the inlet means comprises a vertical chute feeding the material to the rotatable discharge assembly.

3. The container according to claim 2, wherein an upper portion of the container surrounds the chute when the container is suspended.

* * * * *